US009084485B2

(12) United States Patent
Sukman et al.

(10) Patent No.: US 9,084,485 B2
(45) Date of Patent: Jul. 21, 2015

(54) MOUNTING BRACKET

(71) Applicant: Milton Merl & Associates, Inc., Long Island City, NY (US)

(72) Inventors: Joel Sukman, Maspeth, NY (US); Robert Ernst Langelius, Jr., White Plains, NY (US)

(73) Assignee: MILTON MERL & ASSOCIATES, INC., Long Island City, NY (US)

( * ) Notice: Subject to any disclaimer, the term of this patent is extended or adjusted under 35 U.S.C. 154(b) by 177 days.

(21) Appl. No.: 13/921,599

(22) Filed: Jun. 19, 2013

(65) Prior Publication Data

US 2014/0374555 A1 Dec. 25, 2014

(51) Int. Cl.
*A47B 96/00* (2006.01)
*A47B 96/06* (2006.01)

(52) U.S. Cl.
CPC ..... *A47B 96/06* (2013.01)

(58) Field of Classification Search
CPC combination set(s) only.
See application file for complete search history.

(56) References Cited

U.S. PATENT DOCUMENTS

| | | | | | |
|---|---|---|---|---|---|
| 1,974,050 | A | * | 9/1934 | Keil | 248/243 |
| 2,839,350 | A | * | 6/1958 | Hill et al. | 312/351 |
| 3,037,733 | A | * | 6/1962 | Roman | 248/220.43 |
| 3,456,970 | A | * | 7/1969 | Sunasky | 403/319 |
| 3,612,290 | A | | 10/1971 | Evans | |
| 3,881,829 | A | * | 5/1975 | James | 403/27 |
| 3,986,318 | A | | 10/1976 | McConnell | |
| 4,133,433 | A | * | 1/1979 | Wolf | 211/192 |
| 4,222,542 | A | * | 9/1980 | Wilson et al. | 248/243 |
| 4,228,906 | A | * | 10/1980 | Jones | 211/88.01 |
| 4,387,872 | A | * | 6/1983 | Hogue | 248/221.11 |
| 4,405,110 | A | * | 9/1983 | Gibbons | 248/220.22 |
| 4,441,619 | A | * | 4/1984 | Gibitz | 211/70.6 |
| 4,928,912 | A | * | 5/1990 | Florek | 248/220.43 |
| 5,025,937 | A | | 6/1991 | King | |
| 5,165,640 | A | * | 11/1992 | Williams, 3rd | 248/220.43 |
| 5,350,074 | A | * | 9/1994 | Rosenband | 211/192 |
| 5,373,793 | A | * | 12/1994 | Crossman | 108/42 |
| 5,407,160 | A | * | 4/1995 | Hollingsworth et al. | 248/220.43 |
| 6,003,685 | A | * | 12/1999 | Malin | 211/7 |
| 6,004,065 | A | * | 12/1999 | Higdon et al. | 403/384 |
| 6,189,847 | B1 | * | 2/2001 | Hart | 248/220.31 |
| 6,241,109 | B1 | * | 6/2001 | Kautz et al. | 211/192 |
| 6,626,407 | B1 | * | 9/2003 | Miller et al. | 248/250 |
| 6,722,619 | B2 | * | 4/2004 | Valiulis et al. | 248/220.31 |
| 7,004,436 | B2 | * | 2/2006 | Knapp | 248/220.22 |
| 7,264,128 | B2 | | 9/2007 | Herzog et al. | |
| 7,575,212 | B1 | * | 8/2009 | Langelius | 248/243 |
| 2005/0072746 | A1 | * | 4/2005 | O'Brien | 211/59.1 |
| 2008/0302747 | A1 | | 12/2008 | Nance | |
| 2009/0107944 | A1 | | 4/2009 | Goldberg | |

* cited by examiner

*Primary Examiner* — Monica Millner
(74) *Attorney, Agent, or Firm* — Ladas & Parry LLP

(57) ABSTRACT

A mounting bracket for a slotted member such as a upright for a display fixture to allow shelves and other components to be mounted to the fixture has a main body portion having a connector bore for the component element to be affixed to the bracket. A hook at a first end of the main body engages a wall of a slot in the slotted member, while a tab at a second end of the main body member is offset rearwardly from the body member by an arm, the arm and tab being spaced from the hook a distance such that the arm extends through another slot of the slotted member. At least one of the hook and arm are position to engage an edge of the slot of the slotted member to position the bracket on the member. A portion of the tab lies behind a further slot when the bracket is installed on the slotted member, and has a threaded bore to accept a mounting bolt inserted from the front side of the slotted member to fix the mounting bracket in place on the slotted member.

8 Claims, 5 Drawing Sheets

MOUNTING BRACKET

The present invention relates to a mounting bracket intended to be used in conjunction with slotted members, such as uprights, that are typically employed in the construction of storage and display fixtures used in retail store environments. The bracket facilitates the mounting of trays, shelves, baskets and the like to the uprights without the need for specialized mounting elements on the components to be so mounted themselves.

BACKGROUND OF THE INVENTION

Modular storage and display structures, such as used in retail stores to present products on the selling floor, typically are constructed from a plurality of slotted metal upright members that are interconnected to provide a display backboard or skeleton of the desired configuration. FIG. 1 presents one such illustrative display unit 10, wherein pairs of slotted uprights 12 and joined by perforated back panels 14 and channel members 16 in known manners to create a series of wall units that are in turn connected together to form the desired display assembly. Components to be mounted to the wall units, such as trays 18, are supported by, and connected to, the uprights 12 by hook brackets 20 that engage with the slots of the uprights. The hook brackets 20 are typically formed as integral parts of the component to be mounted, and adds cost and complexity to the component. Including integral hook brackets also limits the versatility of the component, as the hooks must be spaced from each other the precise distance between the uprights to which the component is to be mounted.

Accordingly, it is a purpose of the present invention to provide a mounting bracket for use in mounting components to such slotted members, such as uprights, which avoids the need for the component to be constructed with integral hook brackets. A further purpose of the present invention is to provide a mounting bracket that can serve as a universal mounting interface between a component to be mounted to slotted upright members and the slotted members.

Yet a further purpose of the present invention is to provide a mounting bracket for mounting components to slotted members that is economical to produce, simple to install, and efficient in use.

BRIEF DESCRIPTION OF THE INVENTION

In accordance with the foregoing and other objects and purposes, a mounting bracket of the present invention has a main portion overlying a front face of the slotted upright to which it is mounted. The main portion is provided with a connector, such as a threaded bore, that can mate with a cooperating element, such as a bolt, which in turn secures the component to the bracket.

The mounting bracket has a rearwardly-directed hook at a first end of the main portion adapted to fit through a first slot of the upright whereby the bracket is supported by the inner surface of the hook upon the lower edge of the slot. A depending tab is positioned at a second end of the bracket, likewise adapted to fit through a second slot of the upright and extend downwardly behind the upright. The tab is provided with a portion of increased width greater than the width of the slot, the portion being provided with a threaded bore. With the bracket mounted on the upright the increased width portion is aligned with and behind a third slot. A mounting bolt, inserted through the third slot from the front of the upright and through the threaded bore, draws the bracket against the rear surface of the upright to rigidly retain it in position, the increased width portion preventing the bracket from being pulled into the third bore.

With the bracket in place on the upright, the desired component can be affixed to the bracket as desired, whereby the component is in place on the fixture.

BRIEF DESCRIPTION OF THE DRAWINGS

A fuller understanding of the present invention will be comprehended upon review of the following detailed description thereof, when considered in association with the annexed drawings, wherein.

DETAILED DESCRIPTION OF THE INVENTION

Figure 1:
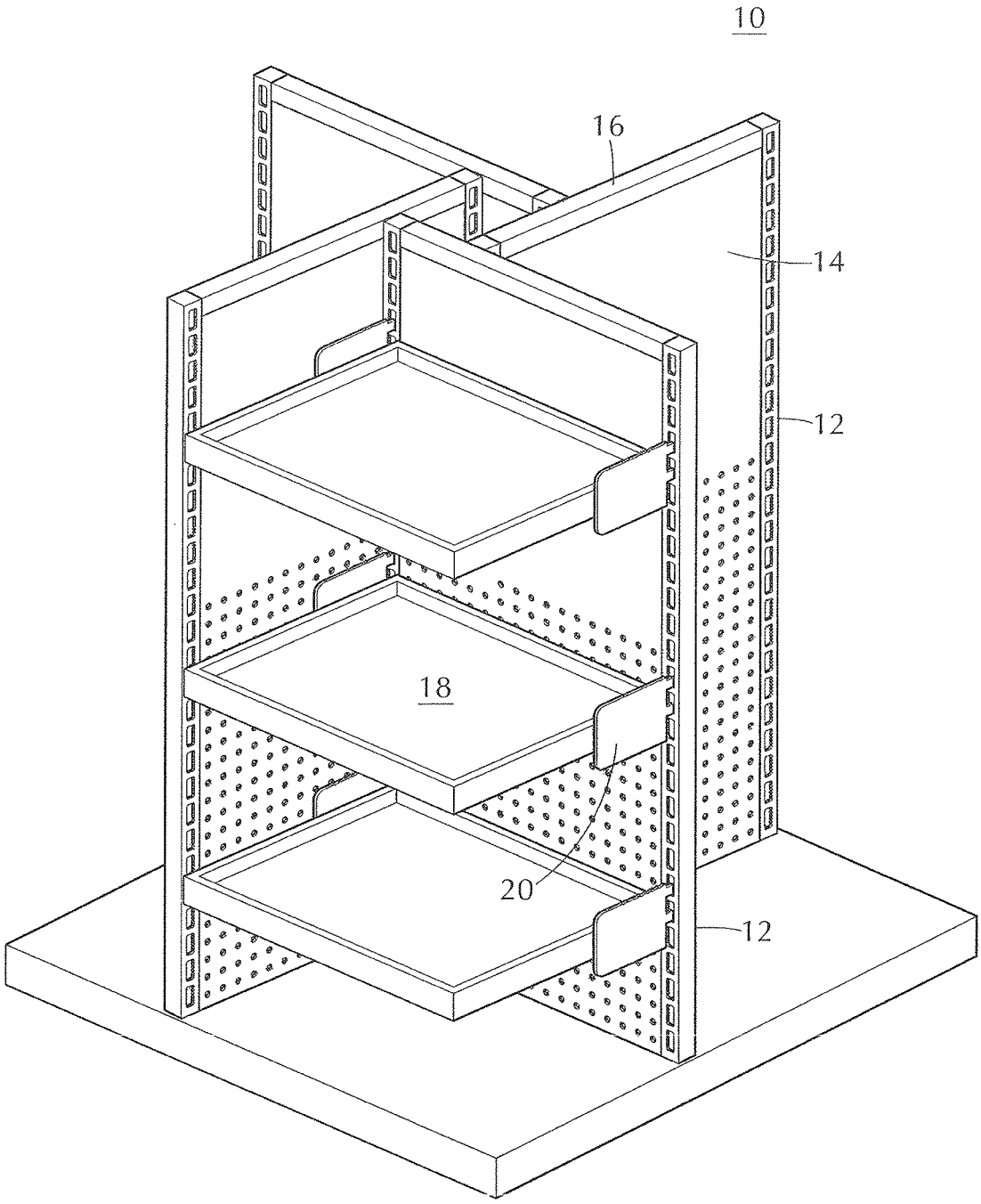
FIG. 1 PRIOR ART
FIG. 1 is a view of a representative display fixture of the prior art incorporating slotted uprights.
Figure 3:
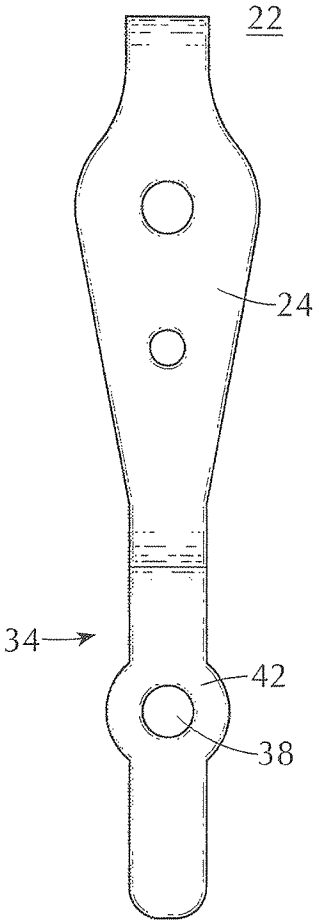
FIG. 3 is a front elevation view of the bracket.
Figure 2:
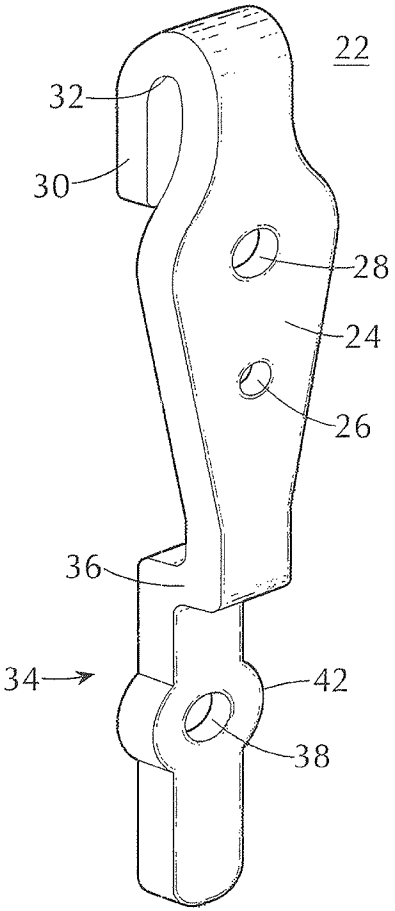
FIG. 2 is a perspective view of a bracket of the present invention.
Figure 5:
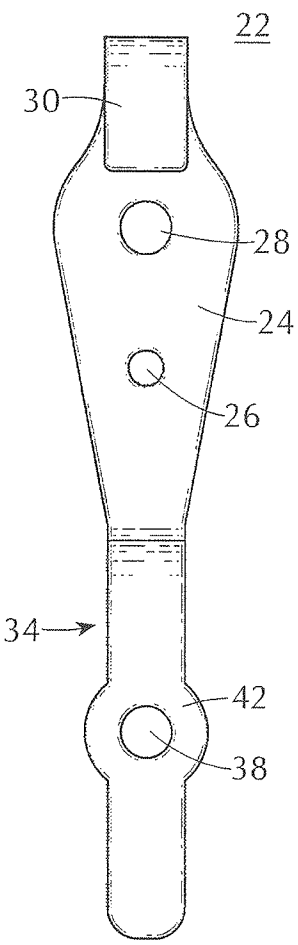
FIG. 5 is rear elevation view thereof.

Again with initial reference to FIG. 1, the bracket of the present invention is intended to allow the mounting of a component, such as tray 18, to slotted uprights 12 without the need for hooked brackets 20 which typically are integral with the component to be mounted.

With reference to FIGS. 2-5, inventive bracket 22, which may be formed of an appropriate strong and rigid material, such as steel, has a main body portion 24 that is provided with a connector which may be in the form of a throughbore 26. The throughbore may be threaded to accept a mounting bolt (not shown) for the component, such as a tray 18, to be connected to the bracket and in turn to be mounted to the fixture uprights. The main body portion may be of any width and contour chosen to provide sufficient rigidity and support for the bolt and thus the component to be joined to and supported by the bracket. The main body portion may be provided with a second bore 28 for affixing the bracket to the upright, as will be discussed infra.

The main body portion is provided with a hook 30 at a first end, with a width chosen to allow it to be inserted through a chosen slot of the upright to allow the bracket to be embraced by the hook, the inner surface 32 of the curved portion of the hook typically wrapping about or resting on the lower edge of a first upright slot through which the hook is inserted.

Figure 4:
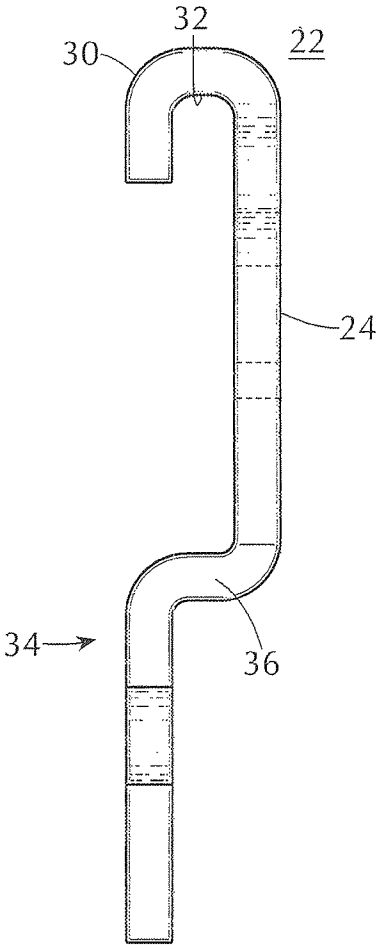
FIG. 4 is a side elevation view thereof.
Figure 7:
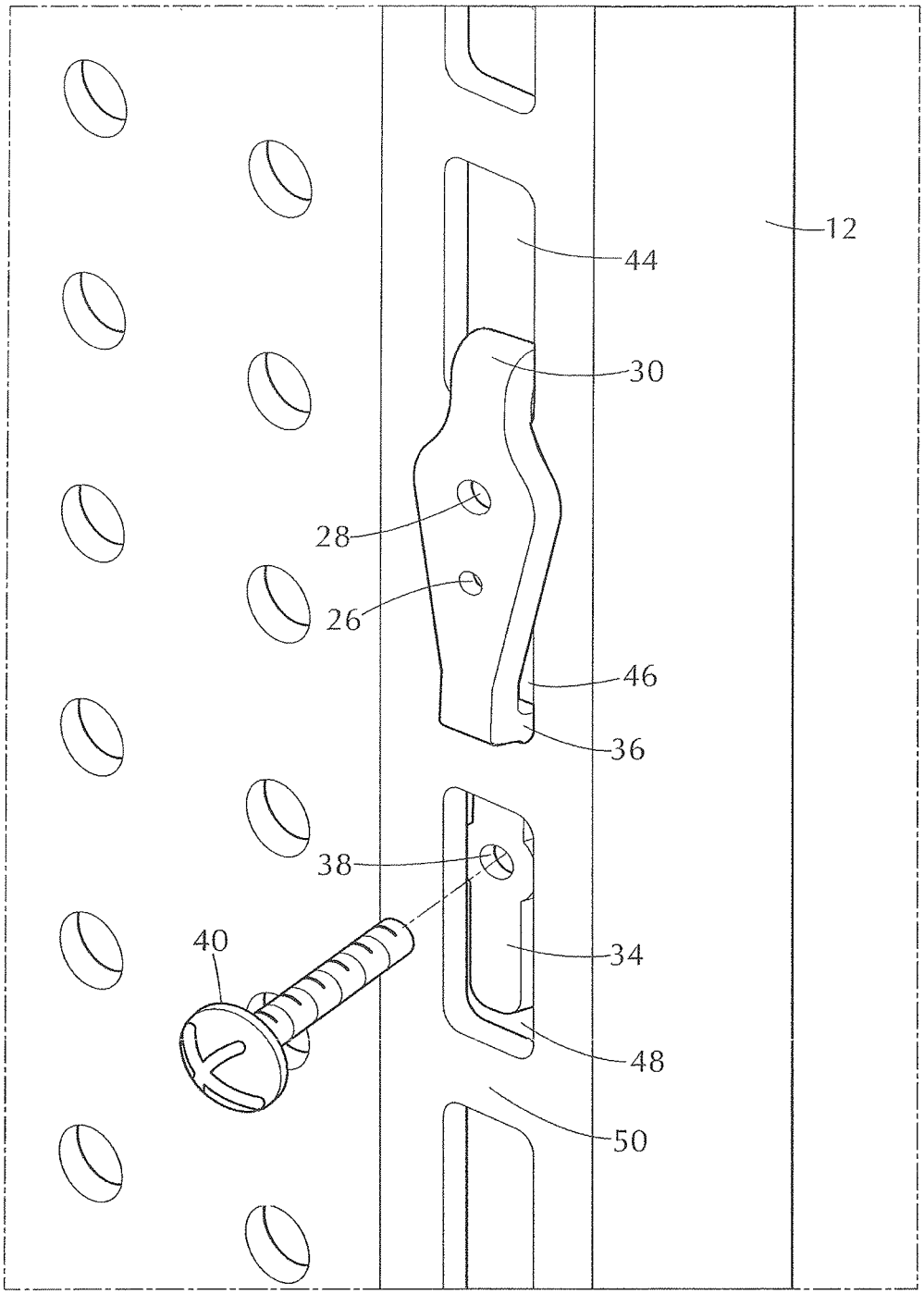
FIG. 7 is a perspective view depicting the bracket in place on an upright for acceptance of a mounting bolt.

Tab portion 34 of the bracket is offset rearwardly from a second end of the main body portion 24 by offsetting arm 36, whereby the tab lies behind the upright the tab is inserted through a second upright slot when the bracket is mounted thereon. Preferably the arm 36 is dimensioned such that the front surface of the tab lies in the same plane as the front (inner) surface of the hook, as best seen in FIG. 4. The tab is provided with a bore 38, which is preferably threaded to accept a mounting bolt 40 as shown in FIG. 7. The tab area 42 surrounding the bore may be of increased width as compared to the other portions of the tab to maintain appropriate structural rigidity for the tab, and to engage the rear surface of the upright, as will be further illustrated infra.

As seen in FIG. 7, the overall length of the bracket is such that, when installed on the slotted upright 12, the hook 30 is engaged about a lower surface of first slot 44, while tab 34 passes through a second slot 46 and lies behind a third slot 48. While the bracket may preferably be positioned vertically with respect to the upright by the tab arm 36 resting upon the lower horizontal edge of the second slot, main body portion 24 can be dimensioned to have a length such that hook 30 likewise rests upon the lower surface of first slot 44, whereby the bracket is supported upon the upright at two locations. Conversely, the main body portion of the bracket may be dimensioned such that the bracket is supported upon the upright solely by the hook, the tab arm being elevated above the lower edge of the slot through which it extends. With slotted uprights of conventional construction and spacing, the overall length of the bracket may be on the order of 3.6 inches, with the distance between the upright-engaging portion of the hook and the lower surface of the tab arm 36 being on the order of 2 inches.

Figure 6:
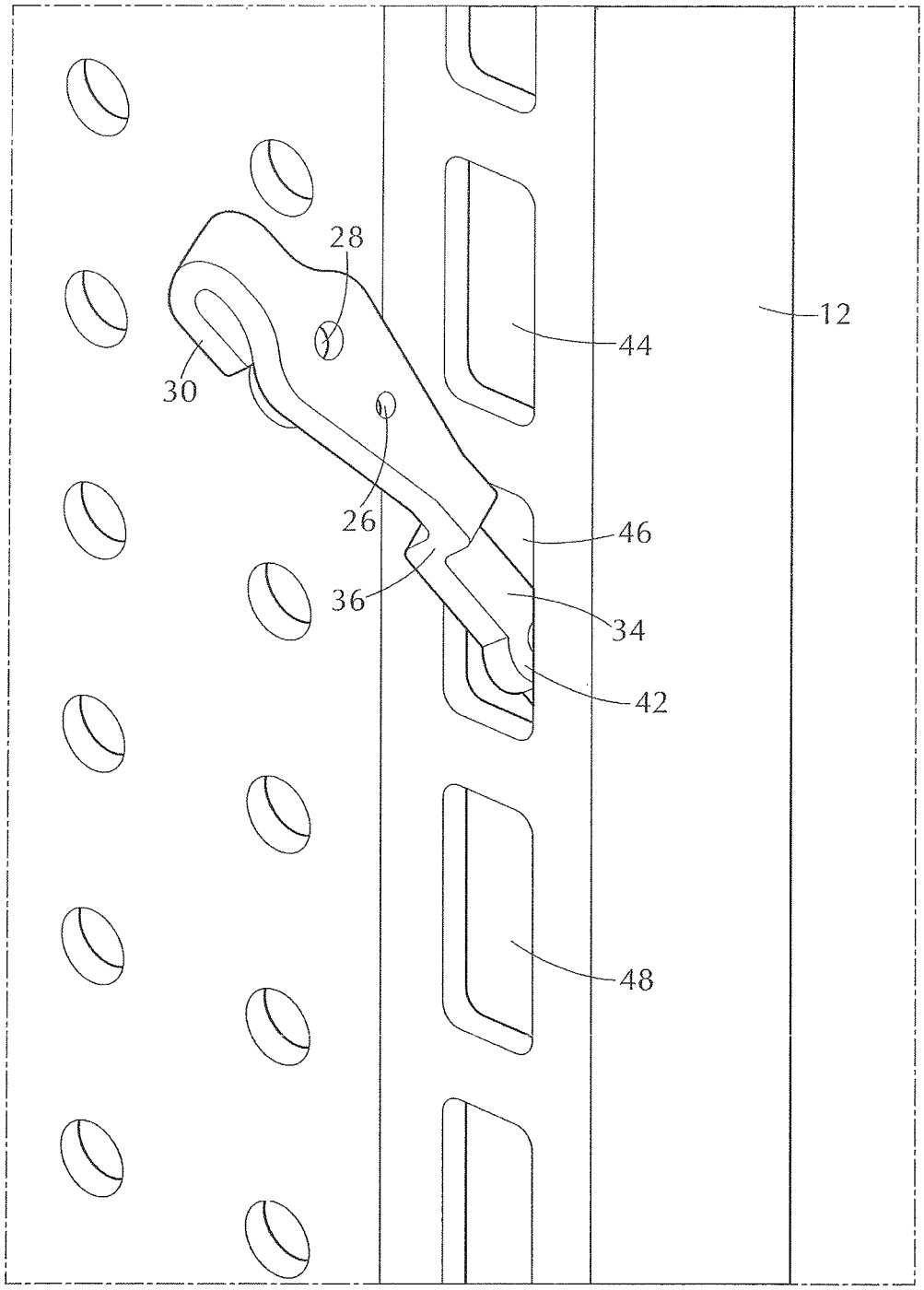
FIG. 6 is a perspective view depicting the insertion of the bracket into a slot of an upright.

To mount the bracket, the tab 34 is inserted through (second) slot 46 as depicted in FIG. 6. Because the width of the area 42 surrounding the tab bore 42 may be greater than the width of the slots in the upright 12, the bracket can be inserted through the slot sideways, allowing the area 42 to pass through the slot, whose height is substantially greater than its width. With the area 42 clearing the slot, the bracket can be rotated to its proper position and the hook aligned with and inserted into its receiving slot 44. The bracket is then lowered such that the tab arm 36 engages its slot edge, and hook 30 wraps about the lower edge of its slot 46, as shown in FIG. 7. So inserted, tab 34 will lie behind slot 48, exposing bore 38. Bolt 40 is then threaded into the bore and tightened down, the head of the bolt resting against the front surface of the upright and drawing the tab against the rear surface of the upright, rigidly retaining the bracket in place. Because the width of the area 42 is greater that the slot width, the tab is not pulled into the slot, and because the tab rests against the back surface of the upright there is no flexure of the bracket due to the bolt.

It is to be appreciated that the length of tab 34 may be such that it can extend downward below the bottom edge of slot 48. In such a case the tab can provide additional contact surface area between the bracket and upright.

As indicated above, the main body portion of the bracket may be provided with a second threaded bore 52. This bore, which aligns with a bridge area between first and second slots 44, 46, can also accept a bolt to retain the bracket on the upright, engaging the bridge area when tightened down and drawing the bracket forwardly when the end of the bolt contacts the bridge area. Such a connection may provide a bending moment to the bracket, however, and thus use of the tab bore 38 and bolt 40 for mounting is preferred.

We claim:

1. A mounting assembly comprising a vertical slotted member and a mounting bracket:

the mounting bracket comprising:

a main body portion having a front surface abutting against a rear surface of an element to be mounted to the slotted member, a rear surface abutting against a front surface of the slotted member, and a connector first bore for mounting the element to the bracket;

a rearwardly-facing hook at a first end of the main body portion engaging a wall of a slot in the slotted member, forward and rear walls of the hook embracing the wall;

a non-expandable tab at a second end of the main body member offset rearwardly from the body member by an arm, the arm and tab being spaced from the hook a distance such that the arm extends through another slot of the slotted member with the tab behind and overlying a further slot on the slotted member, the tab having a width that exceeds a width of the further slot and the arm having a width not exceeding the width of the further slot; and a threaded second bore extending through the mounting bracket to accept a mounting bolt to retain the mounting bracket in place on the slotted member.

2. The mounting assembly of claim 1 wherein the threaded second bore is located on the tab to align with the further slot.

3. The mounting assembly of claim 2 further including a mounting bolt having a head surface in contact with the main body portion front surface engaging the threaded second bore and drawing the mounting bracket against the slotted member.

4. The mounting assembly of claim 1 further including a mounting bolt, wherein the threaded second bore is located on the main body portion and located to align with a bridge area between slots in the slotted member, the mounting bolt being inserted into the threaded second bore with an end of the bolt applying force against the bridge area to retain the mounting bracket in position.

5. The mounting assembly of claim 1 wherein the connector is a threaded bore in the main body portion.

6. The mounting assembly of claim 1 wherein the slotted member is a vertical upright and the arm is located on the bracket to rest upon a lower edge of the another slot.

7. The mounting assembly of claim 1 wherein slotted member is a vertical upright and the arm is located on the bracket whereby the bracket hook rest upon a lower edge of the slot.

8. The mounting assembly of claim 1 wherein the slotted member is a vertical upright and the arm is located on the bracket whereby the arm rests upon a lower edge of the another slot and the bracket hook rest upon a lower edge of the slot.

* * * * *